US005699568A

United States Patent [19]

Couldridge

[11] Patent Number: 5,699,568

[45] Date of Patent: Dec. 23, 1997

[54] STRETCHER FOR IMMOBILIZING A PATIENT OR CASUALTY

[76] Inventor: Paul R. Couldridge, 21 Woodbridge Rd., Hamilton, Ontario, Canada, L8K 3C6

[21] Appl. No.: 839,733

[22] Filed: Apr. 15, 1997

Related U.S. Application Data

[63] Continuation of Ser. No. 648,630, May 13, 1996, abandoned.

[51] Int. Cl.[6] ..... A61G 1/00

[52] U.S. Cl. ..... 5/628; 5/625; 5/110

[58] Field of Search ..... 5/628, 625, 110, 5/111, 494; 294/140; 296/20

[56] References Cited

U.S. PATENT DOCUMENTS

| | | | |
|---|---|---|---|
| 2,489,828 | 11/1949 | Springer | 5/628 |
| 3,601,824 | 8/1971 | Bradford | 5/628 |
| 3,986,505 | 10/1976 | Power | 5/625 |
| 4,124,908 | 11/1978 | Burns et al. | 5/628 |
| 4,601,075 | 7/1986 | Smith | 5/628 |
| 4,679,260 | 7/1987 | Frettem | 5/628 |
| 4,922,562 | 5/1990 | Allred et al. | 5/628 |
| 5,044,031 | 9/1991 | Sherwood et al. | 5/625 |

*Primary Examiner*—Suzanne Dino
*Assistant Examiner*—Fredrick Conley
*Attorney, Agent, or Firm*—Rogers & Scott

[57] ABSTRACT

A stretcher for immobilizing a patient or casualty has a wrap-around flexible sheet member with a longitudinally extending medial portion positionable under a patient or casualty and side panel portions extending laterally outwardly from opposite sides of the medial portion. One side panel portion is foldable across the top of a patient or casualty and the other side panel portion is foldable across the top of the patient or casualty and the top of the one side panel portion. Each side panel portion has at least one slit which is substantially vertically aligned with a corresponding slit in the other side panel portion, when the side panel portions are folded across the top of a patient or casualty, to provide access to the patient or casualty through the aligned slits. Longitudinally spaced adjustable fastening devices are provided to secure the other side panel portion in place across the top of the patient and the one other side panel portion.

3 Claims, 4 Drawing Sheets

STRETCHER FOR IMMOBILIZING A PATIENT OR CASUALTY

This application is a Continuation of U.S. patents application Ser. No. 648,630 filed May 13, 1996, now abandoned.

This invention relates to stretchers for immobilizing patients or casualties.

Patients or casualties frequently have to be immobilized on a stretcher for transportation from one place to another, and many different types of stretchers have been previously proposed for this purpose. However, known stretchers of this kind have various disadvantages and are not particularly satisfactory in practice. Also, further complications occur if the patient or casualty has to be efficiently thermally insulated as well as immobilized. It is therefore an object of this invention to provide an improved stretcher for immobilizing a patient or casualty and for efficiently thermally insulating the patient or casualty if necessary.

The present invention provides a stretcher for immobilizing a patient or casualty comprising a wrap-around flexible sheet member having a longitudinally extending medial portion positionable under the patient or casualty and side panel portions extending laterally outwardly from opposite sides of the medial portion. One side panel portion is foldable across the top of the patient or casualty, and the other side panel portion is foldable across the top of the patient or casualty and the top of the first mentioned side panel portion. Each side panel portion has at least one slit which is substantially vertically aligned with a corresponding slit in the other side panel portion, when the side panel portions are folded across the top of the patient or casualty, to permit access to the patient or casualty through the aligned slits. Longitudinally spaced adjustable fastening devices are provided to secure the second mentioned side panel portion in place across the top of the patient or casualty and the first mentioned side panel portion.

The medial portion of the sheet member may have a second layer providing a longitudinal extending pocket into which a backboard can be inserted. Each side panel portion may have a laterally outer edge with a longitudinal extending tunnel containing a strengthening rod.

The sheet member may have a forward pair of laterally spaced apertures and a rear pair of laterally spaced apertures to enable feet of a conventional collapsible stretcher to be passed therethrough.

The sheet member may comprise an outer part of waterproof material and an inner part of thermally insulated material.

The sheet member may have a pair of longitudinally extending tunnels adjacent opposite sides of the medial portion to receive a pair of stretcher poles.

Embodiments of the invention will now be described, by way of example, with reference to the accompanying drawings, of which:

FIG. 1 is an exploded perspective view of the outer and inner parts of a stretcher in accordance with one embodiment of the invention, FIG. 2 is a detailed view taken along the line 2—2 of FIG. 1, FIG. 3 is a perspective view of a patient or casualty lying on a conventional stretcher and about to be immobilized thereon by the stretcher in accordance with the invention shown in FIG. 1, FIG. 4 is a side view showing the patient or casualty immobilized by the stretcher of FIG. 1.

Figures 1, 2:
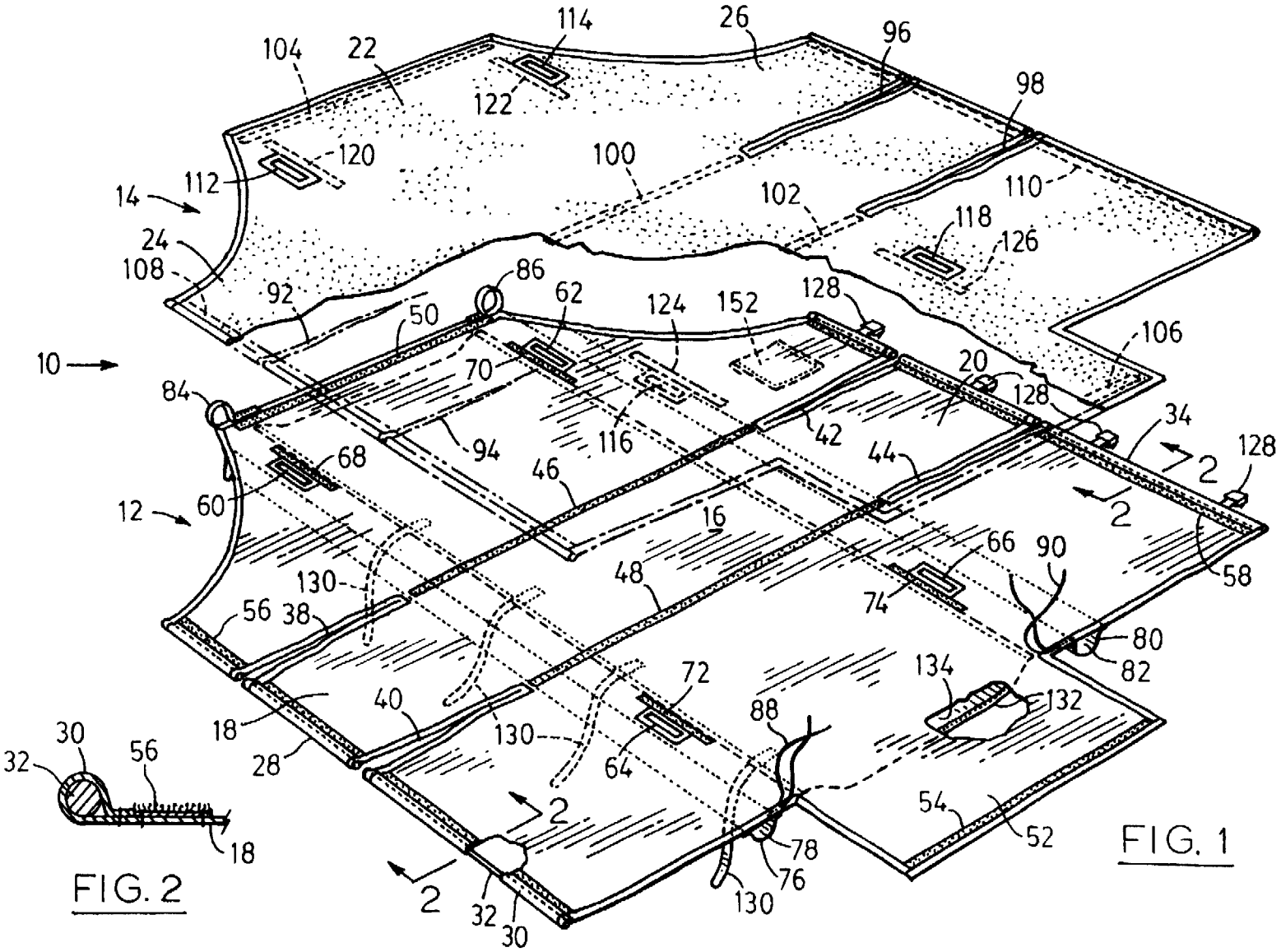

Referring to the drawings, FIG. 1 shows a stretcher 10 in accordance with one embodiment of the invention comprising an outer part 12 of suitable flexible waterproof material and an inner part 14 of suitable flexible thermally insulating material.

The waterproof outer part 12 has a longitudinal extending medial portion 16 positionable under a patient or casualty, as will be described in more detail later, and side panel portions 18, 20 extending laterally upwardly from opposite sides of the medial portion 16. Similarly, the insulating inner portion 14 has a longitudinal extending medial portion 22, and side panel portions 24, 26 extending laterally outwardly from opposite sides of the medial portion 22.

The side panel portion 18 of the waterproof outer part 12 has two longitudinally spaced transversely-extending slits 38, 40 which extend laterally inwardly from the laterally outer edge 28 to a position near the medial portion 16 to form three flaps. Similarly, the side panel portion 20 of the waterproof outer part 12 has two longitudinally spaced transversely-extending slits 42, 44 which extend laterally inwardly from the laterally outer edge 34 to a position near the medial portion 16 to form three flaps, the slits 42, 44 being transversely aligned with the slits 38, 40 respectively.

The laterally outer edge 28 of each flap of the side panel portion 18 of the waterproof outer part 12 is folded over and stitched to form a longitudinal extending tunnel 30 which contains a strengthening rod 32 extending from front to rear thereof. Similarly, the laterally outer edge 34 of each flap of the side panel portion 20 of the waterproof outer part 12 is folded over and stitched to form a tunnel which contains a strengthening rod 36, see FIGS. 5 and 6.

The upper surface of the waterproof outer part 12 has a series of Velcro strips attached thereto to enable the insulating upper part 14 to be secured thereto as will be described in more detail later. Two Velcro strips 46, 48 extend across the medial portion 16 in alignment with the slits 38, 42 and 40, 44 respectively. A Velcro strip 50 extends across the medial portion 16 at the front end. The medial portion 16 is extended beyond the side panel portions 18, 20 at the rear to provide a rear extension 52, and a Velcro strip 54 extends across the rear end of the extension 52. Further Velcro strips 56, 58 are provided adjacent the laterally outer edges 28, 38 of the side panel portions 18, 20 respectively.

The medial portion 16 of the waterproof outer part 12 has a forward pair of laterally spaced rectangular apertures 60, 62 and a rear pair of laterally spaced rectangular apertures 64, 66 for a purpose to be described later. Longitudinally extending Velcro strips 68, 70, 72, 74 are also provided adjacent the apertures 60, 62, 64, 66 on the laterally inner sides thereof.

The side panel portion 18 of the outer waterproof part 12 has a length of waterproof material 76 sewn along its opposite side edges to the lower surface of the outer part 12 to form a longitudinal extending tunnel 78, and the side panel portion 20 has a length of waterproof material 80 sewn along its opposite side edges to the lower surface of the outer part 12 to form a longitudinally extending tunnel 82, again for a purpose to be described later.

The medial portion 16 also has two loops 84, 86 at its front end adjacent the side panel portions 18, 20 respectively, and two pairs of flexible ties 88, 90 at its rear end adjacent the side panel portions 18, 20 respectively.

The side panel portion 24 of the insulating inner part 14 has two longitudinally spaced transversely-extending slits 92, 94 positioned for alignment with the slits 38, 40 in the outer part 12, and the side panel portion 26 of the inner part 16 has two longitudinally spaced transversely-extending slits 96, 98 positioned for alignment with the slits 42, 44 in the outer part 12.

The lower surface of the insulating inner part 14 has a series of Velcro strips attached thereto and positioned to engage the respective Velcro strips on the upper surface of the waterproof outer part 12. Thus, the lower surface of the inner part 14 has strips 100, 102 engageable with strips 46, 48, a strip 104 engageable with the strip 50, a strip 106 engageable with the strip 54, and strips 108, 110 engageable with the strips 56, 58.

The inner part 14 also has a forward pair of rectangular apertures 112, 144 alignable with the apertures 60, 62, and a rear pair of rectangular apertures 116, 118 alignable with the apertures 64, 66. Also, the inner part 14 has Velcro strips 120, 122, 124, 126 alignable with the strips 68, 70, 72, 74.

The outer part 12 is also provided with fastening devices to enable the side panel portion 20 to be secured in place as will be described in more detail later. The fastening devices comprise four longitudinally spaced buckles 128 of known kind secured to the laterally outer edge 34 of the side panel portion 20, and four longitudinally spaced straps 130 secured to the lower surface of the medial portion 16 of the outer part 12 adjacent the side panel portions 18.

The medial portion 16 of the waterproof outer part 12 has a second layer of waterproof material 132 attached at its side edges to the medial portion 16 to provide a longitudinally extending pocket 134 having a width substantially equal to the width of the medial portion 16 for receiving a backboard as will be described in more detail later.

Figure 3:
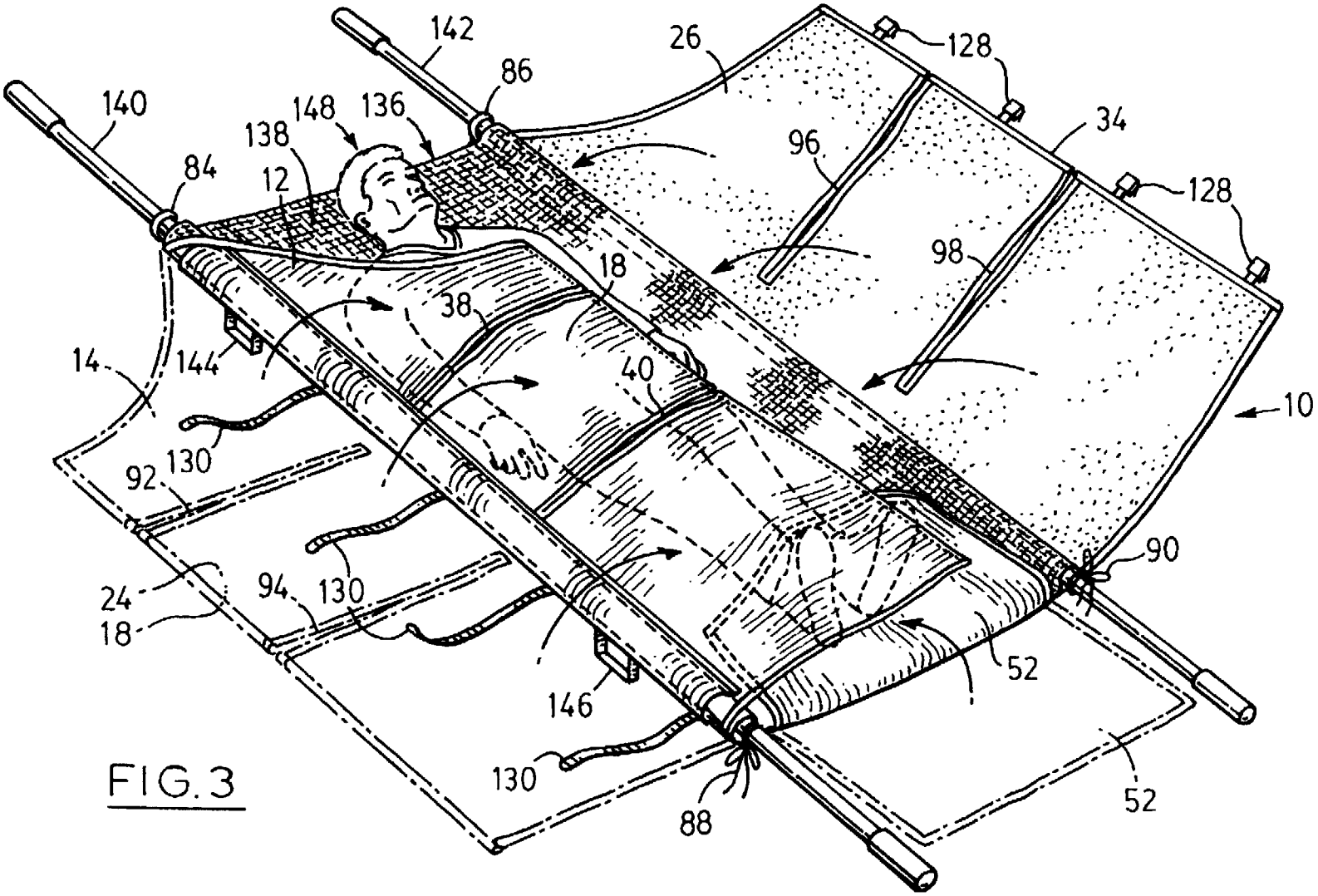
Figure 4:
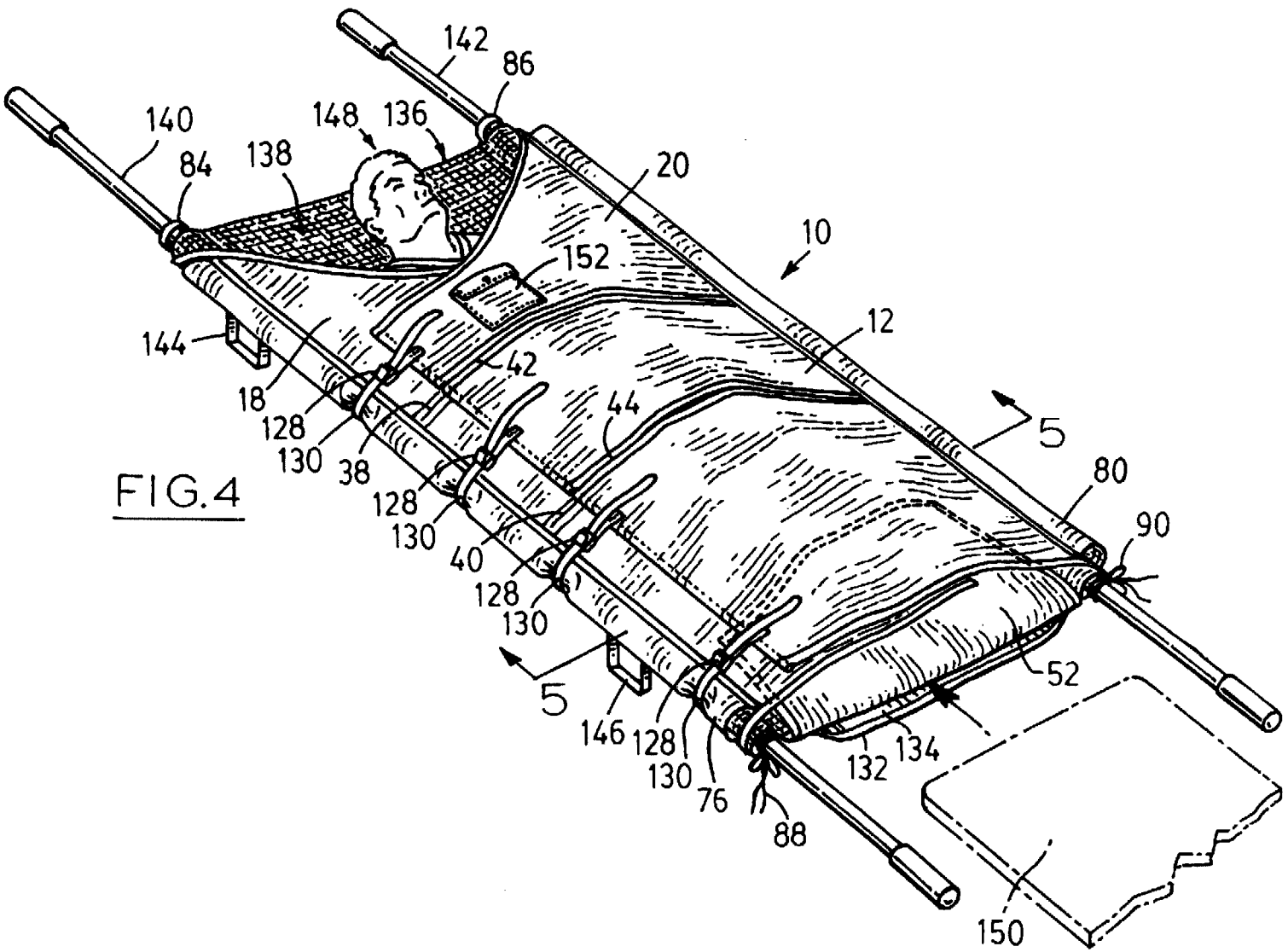
Figure 5:
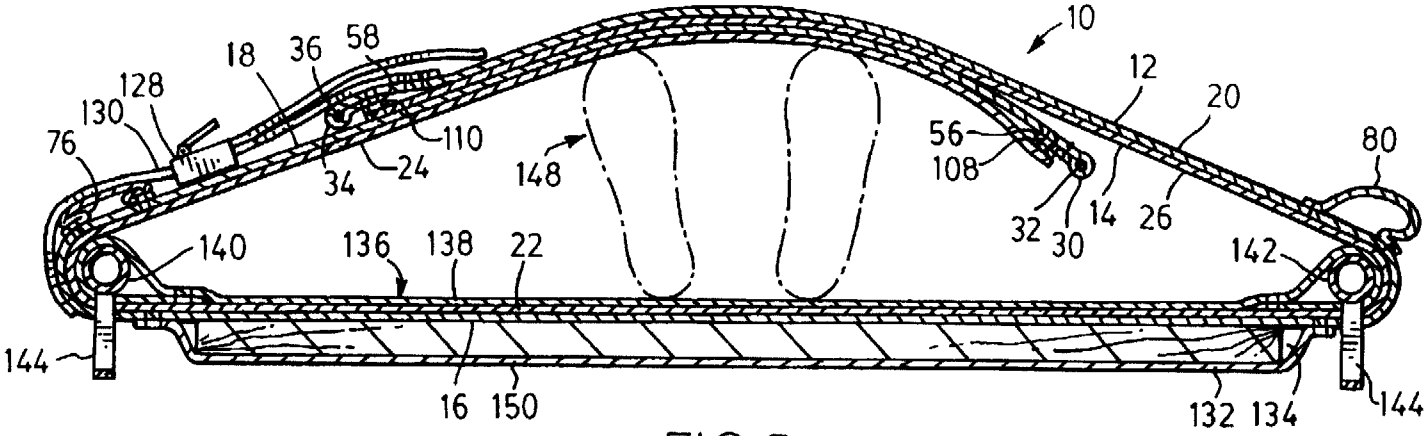
FIG. 5 is a sectional view along the line 5—5 of FIG. 4.

One manner in which the stretcher 10 in accordance with the invention shown in FIG. 1 can be used is with a conventional collapsible stretcher 136 as shown in FIGS. 3 to 5. The conventional stretcher 136 comprises a length of canvas or similar material 138 with outer side edges folded over and stitched to provide tunnels through which carrying poles 140, 142 extend. Each carrying pole 140, 142 has front and rear feet 144, 146 which pass downwardly through apertures in the canvas material 138. Transverse bracing struts (not shown) extend between the carrying poles 140, 142 below the canvas material 138 in known manner to tension the canvas material 138 between the poles 140, 142.

If the insulating part 14 of the stretcher 10 is required, it is placed over the waterproof outer part 12 in alignment therewith so that the various Velcro strips described above engage each other to secure the inner part 14 to the outer part 12. The conventional stretcher 136 with a casualty 148 thereon is then placed on top of the stretcher 10 so that the legs 144, 146 of the conventional stretcher 136 pass downwardly through the rectangular apertures 60, 112, etc., in the stretcher 10.

As shown in FIG. 3, the rear extension 52 is first folded over the feet of the casualty 148, and the side panel portions 18, 24 are then folded over the casualty 148. Referring now more particularly to FIG. 4, the side panel portions 20, 26 are then folded over on top of the other side panel portions 18, 24, and the straps 130 are attached to the buckles 128 and pulled therethrough in known manner to tighten the stretcher 10 around the stretcher 136 and the casualty 148, thereby immobilizing the casualty. As shown, the various side panel portions are shaped so that the whole of the casualty 148 is covered except for the head and neck. If desired, a backboard 150 can be inserted into the pocket 134 below the medial portion 16.

The advantages of this embodiment of the invention can readily be seen from FIG. 4. The casualty 148 is effectively immobilized and also effectively thermally insulated. The slits 42, 44 and the aligned slits therebelow provide ready access to the casualty 148 for intravenous lines and appropriate monitoring equipment, without compromising immobilization or thermal insulation. Also, because of the provision of the slits and by releasing the relevant strap 130 from its buckle 128, the flaps of the side panel portions of the inner and outer parts can be folded back from the closed position shown in FIG. 4 to permit greater access to the upper, middle or lower part of the casualty 148 if desired without having to open other flaps. The side panel portion 20 of the outer part 12 is provided with a small pocket 152 for relevant documentation.

Figure 6:
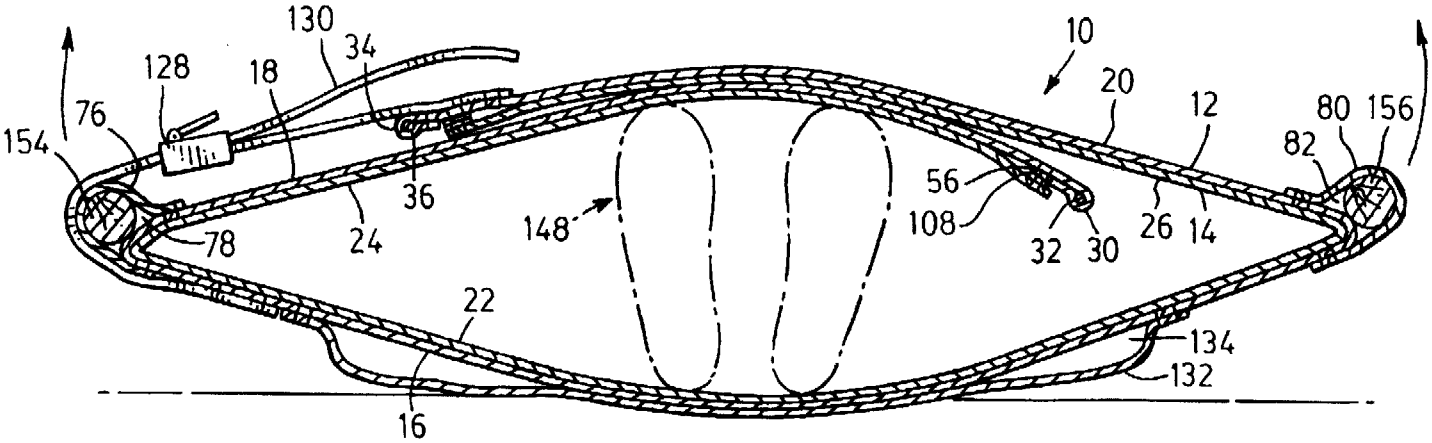
FIG. 6 is a view similar to FIG. 5 but showing the stretcher of FIG. 1 used without a conventional stretcher.

If desired, the stretcher 10 may be used without also using a conventional stretcher and with or without a backboard. In this case, as shown in FIG. 6, stretcher poles 154, 156 are slid through the tunnels 78, 80 provided in the outer part 12. The thermally insulating inner part 14 may of course not be used if such insulation is not required.

Other embodiments and advantages of the invention will be readily apparent to a person skilled in the art from the foregoing description, the scope of the invention being defined in the appended claims.

I claim:

1. A stretcher assembly for immobilizing a patient or casualty comprising:

a wrap-around flexible sheet member having a longitudinally extending medial portion positionable under a patient or casualty and side panel portions extending laterally outwardly from opposite sides of the medial portion, one side panel portion being foldable across the top of a patient or casualty and the other side panel portion being foldable across the top of the patient or casualty and the top of said one side panel portion, each side panel portion having at least one slit which is substantially vertically aligned with a corresponding slit in the other side panel portion, when the side panel portions are folded across the top of a patient or casualty, to provide access to the patient or casualty through the aligned slits, and longitudinally spaced adjustable fastening devices to secure said other side panel portion in place across the top of the patient and said one other side panel portions, the sheet member having a forward pair of laterally spaced apertures and a rear pair of laterally spaced apertures, and a conventional collapsible stretcher having a pair of carrying poles and a length of canvas extending therebetween, each carrying pole having a front foot and a rear foot extending downwardly through apertures in the canvas or similar material, the front feet of the carrying poles also passing downwardly through said forward pair of laterally spaced apertures in the sheet member, and the rear feet of the carrying poles also passing downwardly through said rear pair of laterally spaced apertures in the sheet member.

2. A stretcher assembly according to claim 1 wherein each side panel portion has a laterally outer edge with a longitudinally extending tunnel containing a strengthening rod.

3. A stretcher assembly according to claim 1 wherein the sheet member comprises an outer part of waterproof material and an inner part of thermally insulating material, both the outer part and the inner part having said medial and side panel portions.

* * * * *